United States Patent [19]

Blümle

[11] Patent Number: 4,564,418

[45] Date of Patent: Jan. 14, 1986

[54] PAPER CONVERTING MACHINE VACUUM CYLINDER

[75] Inventor: Martin Blümle, Güllesheim, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 695,745

[22] Filed: Jan. 28, 1985

Related U.S. Application Data

[63] Continuation of Ser. No. 554,983, Nov. 25, 1983, abandoned.

[30] Foreign Application Priority Data

Nov. 26, 1982 [DE] Fed. Rep. of Germany ..... 3243778

[51] Int. Cl.[4] ..... D21F 3/10; F01N 1/10

[52] U.S. Cl. ..... 162/368; 181/256; 181/272

[58] Field of Search ..... 181/212, 230, 239, 272, 181/273, 276, 175, 256; 29/115; 162/368-370

[56] References Cited

U.S. PATENT DOCUMENTS

| | | | |
|---|---|---|---|
| 2,857,823 | 10/1958 | Thiessen | 162/369 |
| 2,882,969 | 4/1959 | Foscue et al. | 162/369 |
| 4,407,390 | 10/1983 | Le Blanc, Jr. | 181/230 |

FOREIGN PATENT DOCUMENTS

| | | | |
|---|---|---|---|
| 1116925 | 5/1956 | France | 181/272 |

*Primary Examiner*—Benjamin R. Fuller
*Attorney, Agent, or Firm*—Collard, Roe & Galgano

[57] ABSTRACT

A noise suppression device is provided for a vacuum cylinder having a control head which is used in high speed paper converting machines and which includes a sound attenuator which is integral with the vacuum cylinder. The sound attenuator incorporates a plurality of attenuation chambers within the vacuum cylinder which are interconnected by tubes arranged in an offset manner to overlap each other in the projection. Air passages are also provided in the side of the vacuum cylinder opposite the control head to connect the last attenuation chamber to the atmosphere.

2 Claims, 1 Drawing Figure

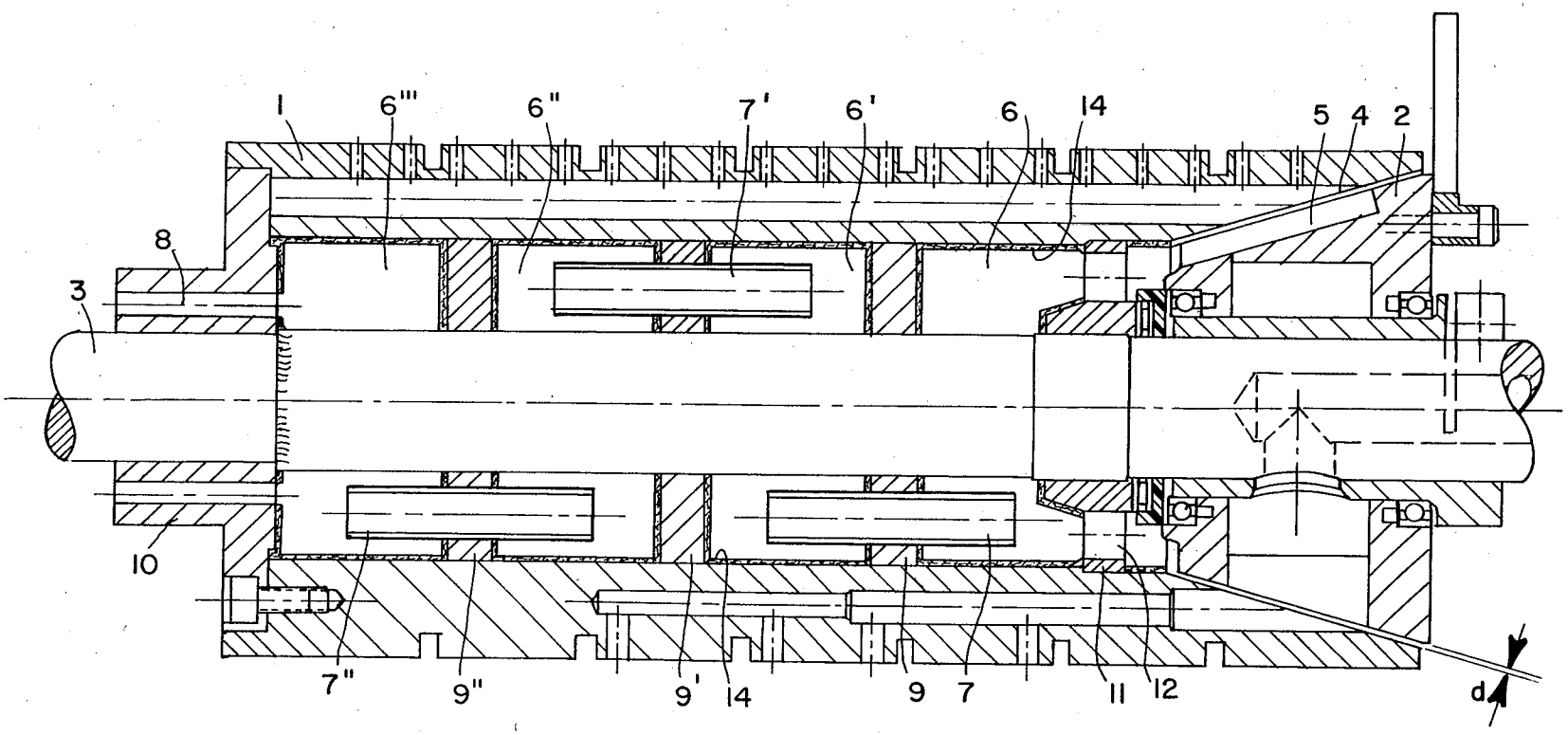
d
2
4
5
14
6
6'
7'
6"
6'''
1
8
3
10
7"
9"
9'
14
9
7
11
12

PAPER CONVERTING MACHINE VACUUM CYLINDER

This application is a continuation of U.S. Ser. No. 554,983, filed Nov. 25, 1983, now abandoned, for NOISE SUPPRESSION DEVICE.

The present invention relates to a device for suppressing the noise in a vacuum cylinder having a control head in a high speed paper converting machine. The control head of such a machine is attached with its control surface at the end face directly at the vacuum cylinder or is inserted therewith into the vacuum cylinder with an accurate fit.

In such high speed paper converting machines having a vacuum cylinder with a control head, a very loud noise is often produced during the atmospheric pressure equalization at the end of each vacuum process by the fresh air in-flow. As a result of increased environmental awareness and in order to comply with various laws and regulations relating to the work place and for the benefit of the employees therein, it is necessary to provide noise suppression for such high speed paper converting machines. It is known to attenuate noise produced by the in-flow fresh air at the control head of such machines by means of a noise suppressor attached to the outside of the control head. Since, at the end of a vacuum process, a certain quantity of fresh air is instantaneously required for the atmospheric pressure equalization, a fresh air reservoir is provided with such a noise suppressor. Thus, such a noise suppressor must be large and mounted directly at the control head as a result of which a large space is required and a torque occurs at the control head because of the large size of the noise suppressor attached on the one side thereof. In addition, in order to avoid mechanical contact and subsequent seizing of the the vacuum surfaces, a large vacuum gap must be established at the control surface between the control head and the vacuum cylinder.

It is, therefore, an object of the present invention to provide at the vacuum air control head optimum noise suppression without interfering with the control function of the control head by means of a device which does not require a great deal of operating space and does not transmit a torque to the control head.

The above object, as well as others which will hereinafter become apparent, is accomplished in accordance with the present invention by providing the control head with a canal for the atmospheric pressure equalization which is open on the control surface thereof toward the interior of the vacuum cylinder and the interior of the vacuum cylinder is designed as a sound attenuator. The interior of the vacuum cylinder is subdivided into attenuation chambers which are interconnected by tubes which are arranged in an offset manner to overlap each other in the projection. Holes are provided in the side of the vacuum cylinder opposite the control head to connect the last attenuation chamber to the atmosphere. The advantages obtained with such a device are that the interior space of the vacuum cylinder is made into an efficient noise suppressor with a minimum of effort and cost having a large volume which, therefore, does not interfere with the control function of the control head and requires no additional space beside the control head. Also, this sound attenuator produces no negative effect on the support of the control head nor on the vacuum gap between the control head and the vacuum cylinder.

The present invention will be described and understood more readily when considered together with the accompanying FIGURE which is a cross-sectional view of a vacuum cylinder having a control head and incorporating the noise suppressor of the instant invention.

Turning to the drawing, there is shown a conically shaped control head 2 supported coaxially on shaft 3 free from rotation. Control head 2 is inserted with an accurate fit into revolving vacuum cylinder 1 with a vacuum gap spacing "d". For atmospheric pressure equalization a canal, designated 5, is provided on the control surface 4 of control head 2 which opens toward the interior of vacuum cylinder 1. Vacuum cylinder 1 is supported by means of the perforated head pieces 10 and 11 coaxially on shaft 3 in a positive locking or frictional manner. The interior of cylinder 1 between headpieces 10 and 11 is subdivided by means of partitions 9, 9' and 9'' into four annular chambers, designated 6, 6', 6'' and 6'''. Chambers 6, 6', 6'' and 6''' are respectively connected by means of tubes 7, 7' and 7'' which are arranged in an offset manner to overlap each other in the projection. The surfaces of chambers 6, 6', 6'' and 6''' may be provided with sound absorption material, designated 14, to further absorb the sound therein.

Holes 12 in headpiece 11 are large enough that they offer little resistance to the fresh air which flows during the atmospheric pressure equalization from the reservoir chamber 6 toward the canal 5. The air pressure within chambers 6, 6', 6'', 6''' is equalized again between the individual vacuum intervals by means of the holes 8 in headpiece 10 and tubes 7, 7', 7''. The sound produced at the canal 5, at the end of each vacuum process during the atmospheric pressure equalization by fresh air inflow which flows through the attenuation chamber 6, 6', 6'', 6''' by means of tubes 7, 7' and 7'' which together act as reactances and resonators and is discharged, is attentuated at holes 8 in headpiece 10.

It is understood that the foregoing general and detailed descriptions are exemplary of the present invention and are not to be interpreted as restrictive of the scope of the following claims.

What is claimed is:

1. In a high speed paper converting machine vacuum cylinder wherein a control head is attached at its control surface directly to the end face of a vacuum cylinder or inserted into the vacuum cylinder with an accurate fit and the canal for atmospheric pressure equalization is open on the control surface of the control head toward the interior of the vacuum cylinder, the improvement comprising:

the interior of said vacuum cylinder being subdivided as a reflection sound attenuator into a plurality of annular attenuation chambers interconnected by offset tubes which overlap each other in the projection, and openings in the side of the vacuum cylinder opposite the control head connecting the last attenuation chamber to the atmosphere, so as to suppress the noise resulting from the fresh air inflow during atmospheric pressure equalization at the completion of the vacuum cycle of the vacuum cylinder.

2. The high speed paper converting machine vacuum cylinder as defined in claim 1, which further comprises sound absorption material covering the interior surfaces of said vacuum cylinder.

* * * * *